US011788773B2

(12) United States Patent
Antonsson

(10) Patent No.: US 11,788,773 B2
(45) Date of Patent: Oct. 17, 2023

(54) CARBON DIOXIDE REFRIGERATION SYSTEM WITH LOW TEMPERATURE MODE

(71) Applicant: Carrier Corporation, Palm Beach Gardens, FL (US)

(72) Inventor: Micael Antonsson, Varberg (SE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/569,130

(22) Filed: Jan. 5, 2022

(65) Prior Publication Data

US 2022/0214079 A1 Jul. 7, 2022

(30) Foreign Application Priority Data

Jan. 6, 2021 (EP) ..... 21150423

(51) Int. Cl.
*F25B 49/02* (2006.01)
*F25B 9/00* (2006.01)

(52) U.S. Cl.
CPC ..... *F25B 9/008* (2013.01); *F25B 49/02* (2013.01); *F25B 2400/0411* (2013.01); *F25B 2500/31* (2013.01); *F25B 2600/2501* (2013.01)

(58) Field of Classification Search
CPC .. F25B 9/008; F25B 49/02; F25B 2400/0411; F25B 2500/31; F25B 2600/2501
See application file for complete search history.

(56) References Cited

U.S. PATENT DOCUMENTS

| | | | |
|---|---|---|---|
| 9,897,363 | B2 | 2/2018 | Zimmermann |
| 2004/0003608 | A1 | 1/2004 | Takeuchi |

FOREIGN PATENT DOCUMENTS

| | | | |
|---|---|---|---|
| EP | 3070417 | A1 | 9/2016 |
| JP | 2001108108 | A | 4/2001 |
| JP | 2005076914 | A | 3/2005 |
| WO | 2017087794 | A1 | 5/2017 |

OTHER PUBLICATIONS

Indian Office Action for Application No. 202114046371; dated Jul. 18, 2022; 5 Pages.
European Search Report for Application No. 21150423.8; dated May 27, 2021; 9 Pages.

*Primary Examiner* — Nael N Babaa
(74) *Attorney, Agent, or Firm* — CANTOR COLBURN LLP

(57) ABSTRACT

A refrigeration system for a carbon dioxide based refrigerant fluid, wherein the refrigeration system includes a refrigerant circuit, the refrigerant circuit including a compression device, a heat rejecting heat exchanger, an ejector, a receiver, an expansion device, and a heat absorbing heat exchanger; wherein the ejector includes a primary inlet, a secondary inlet and an outlet; wherein the receiver includes an inlet, a liquid outlet and a gas outlet; wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet; wherein a suction inlet of the compression device is arranged to receive refrigerant fluid from the gas outlet of the receiver.

17 Claims, 2 Drawing Sheets

CARBON DIOXIDE REFRIGERATION SYSTEM WITH LOW TEMPERATURE MODE

FOREIGN PRIORITY

This application claims priority to European Patent Application No. 21150423.8, filed Jan. 6, 2021, and all the benefits accruing therefrom under 35 U.S.C. § 119, the contents of which in its entirety are herein incorporated by reference.

TECHNICAL FIELD

The present disclosure relates to refrigeration systems and more particularly to carbon dioxide based refrigeration systems operable in a low ambient temperature mode.

BACKGROUND

The advantages of carbon dioxide as a refrigerant fluid for various refrigeration applications include being non-flammable and non-toxic, as well as offering favourable environmental properties, i.e. negligible Global Warming Potential (GWP) and zero Ozone Depletion Potential (ODP), and advantageous thermo-physical properties. Carbon dioxide refrigerant fluid (e.g. R744) is also inexpensive in comparison with man-made refrigerants.

However, the performance of simple "CO2 only" vapor-compression systems is significantly more sensitive to ambient temperature than other refrigerant type systems. Specifically, as a result of the critical temperature of CO2 being 31° C., unwanted subcritical or transcritical running conditions arise from fluctuations in the ambient temperature around this value.

Low pressure lift ejector systems are simpler systems than high pressure lift ejector systems. At ambient temperatures of around 17-18° C., the CO2 refrigerant fluid leaves the gascooler at around 23-25° C. At these 'high' temperatures and pressures the low pressure lift ejector is able to operate to provide a pressure lift, entraining and mixing the low pressure fluid from the suction inlet (from the evaporator) with the high pressure fluid from the motive inlet.

However, in especially low ambient temperature conditions, such as in winter, the CO2 refrigerant fluid leaves the gascooler at 'low' temperatures and pressures such that the low pressure lift ejector is unable to provide sufficient pressure lift to entrain the fluid from the suction inlet. In these conditions, the ejector is working as a high-pressure valve but providing no benefits to the system.

Conventionally, in these low-pressure lift ejector systems, a refrigerant pump is used to overcome the insufficient pressure lift across the ejector. However, it will be appreciated that an additional refrigerant pump requires the consumption of additional energy. It will always remain the case that reductions in part usage and energy consumption are desirable.

SUMMARY

According to a first aspect, the invention provides a refrigeration system for a carbon dioxide based refrigerant fluid, wherein the refrigeration system comprises a refrigerant circuit, the refrigerant circuit comprising a compression device, a heat rejecting heat exchanger, an ejector, a receiver, an expansion device, and a heat absorbing heat exchanger; wherein the ejector includes a primary inlet, a secondary inlet and an outlet; wherein the receiver includes an inlet, a liquid outlet and a gas outlet; wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet; wherein a suction inlet of the compression device is arranged to receive refrigerant fluid from the gas outlet of the receiver; and wherein the liquid outlet of the receiver is connected via the expansion device to an inlet of the heat absorbing heat exchanger; characterised in that the refrigerant circuit comprises a bypass line and a bypass control valve, with the bypass line providing a fluid connection between the outlet of the heat rejecting heat exchanger and the expansion device, wherein, in an ejector mode of the refrigeration system, the bypass control valve prevents fluid flow through the bypass line such that all fluid exiting the heat rejecting heat exchanger enters the ejector primary inlet; and wherein, in a bypass mode of the refrigeration system, the bypass control valve permits fluid exiting the heat rejecting heat exchanger to flow through the bypass line to the expansion device and then to the heat absorbing heat exchanger without first passing through the ejector.

The use of a bypass line to avoid operating the ejector at a low pressure lift has the advantage, in comparison to using an additional refrigerant pump to secure an effective pressure lift over the ejector, that it reduces the cost and complexity of the refrigeration system. Furthermore, the bypass line consumes no energy, and thus provides a refrigeration system with a lower overall energy consumption. Effectively, the bypass control line enables the refrigeration system to act as two differing types of refrigerant circuit depending on the state of the bypass control valve, which can be changed based on external conditions. For example, in periods with a lower ambient temperature and hence reduced cooling requirements then the bypass valve can be opened and the bypass line used for an efficient low power/low cooling load mode of operation. Alternatively, when there is a higher ambient temperature the bypass line can be closed and the ejector and receiver components are utilised to provide enhanced performance of the refrigeration system and provide an efficient high power/high cooling load mode of operation.

The bypass control valve may be implemented with any suitable valve arrangement, such as one or more valves in the bypass line and/or at the junction of the bypass line with a line between the heat rejecting heat exchanger and the expansion device. The bypass control valve may comprise an on/off valve. The bypass control valve may be operated manually (e.g. ball or plug valve), or the refrigeration system may comprise a controller for automatic control of the bypass control valve (e.g. solenoid valve), in order to achieve switching between the bypass mode and the ejector mode.

The bypass line may be arranged to provide a direct fluid connection between the outlet of the heat rejecting heat exchanger and an inlet of the expansion device.

The bypass line may provide a fluid flow path (e.g. a conduit, a pipe) between the outlet of the heat rejecting heat exchanger and an inlet of the expansion device that is only interrupted by the bypass control valve. In other words, the bypass line may comprise no further components.

The bypass line may be arranged such that fluid does not undergo heat exchange with another portion of the refrigeration system i.e. lose and/or gain heat to and/or from another portion of the refrigeration system, when flowing from the outlet of the heat rejecting heat exchanger to the inlet of the expansion device through the bypass line.

By providing a direct connection between the outlet of the heat rejecting heat exchanger and an inlet of the expansion device, the number of components (and complexity) of the refrigeration system is minimised. Thus, when operated in the bypass mode, the refrigeration system provides a simple single-stage vapor-compression refrigeration system. Being able to switch to a simple refrigerant circuit with minimal components provides the option of reliable and robust refrigeration of a temperature controlled environment.

The refrigeration system may include a check valve between the liquid outlet of the receiver and the expansion device.

The bypass control valve may be a three-port valve, wherein a first port of the valve may be connected to the expansion device, a second port of the valve may be connected to the bypass line, and a third port of the valve may be connected to the liquid outlet of the receiver. In the ejector mode of the refrigeration system, the bypass control valve may be controlled to allow fluid communication between the first port and the third port; and in the bypass mode of the refrigeration system, the bypass control valve may be controlled to allow fluid communication between the first port and the second port.

A three-port valve may provide the function of the bypass control valve and the check valve in a single valve, thus reducing the number of components of the refrigeration system and accordingly providing improved reliability and reduced cost.

The refrigeration system may comprise a sensor for monitoring an ambient air temperature, and the controller may be configured to control the bypass control valve to switch to the bypass mode of the refrigeration system in response to determining that the ambient air temperature is below a predetermined threshold.

The refrigeration system may comprise a sensor for monitoring an ambient air temperature, and the controller may be configured to control the bypass control valve to switch to the ejector mode of the refrigeration system in response to determining that the ambient air temperature is above a predetermined threshold.

Thus the refrigeration system is provided with the ability to switch between the ejector mode and the bypass mode automatically in response to the ambient air temperature in order to optimise performance based on external conditions.

The refrigeration system may comprise a refrigerant fluid temperature sensor located between the outlet of the heat rejecting heat exchanger and the ejector primary inlet, and the controller may be configured to control the bypass control valve to switch to the bypass mode in response to determining that a sensed pressure at the outlet of the heat rejecting heat exchanger is below a predetermined threshold.

Thus the refrigeration system is provided with the ability to switch between the ejector mode and the bypass mode automatically in response to the temperature of the refrigerant fluid at the outlet of the heat rejecting heat exchanger in order to optimise performance based on internal conditions of the refrigeration system.

The refrigerant circuit may not generally include any further components, i.e. it may consist of a compression device, a heat rejecting heat exchanger, an ejector, a receiver, an expansion device, a heat absorbing heat exchanger, a bypass line, a bypass control valve and a check valve.

The refrigerant circuit may not include any other components between the compression device and the heat rejecting heat exchanger.

The refrigerant circuit may not include any other components between the heat rejecting heat exchanger and the primary inlet of the ejector.

The refrigerant circuit may not include any other components between the ejector outlet and the inlet of the receiver.

The refrigerant circuit may not include any other components between the gas outlet of the receiver and the compression device.

The refrigerant circuit may not include any other components between the heat rejecting heat exchanger and the bypass control valve.

The refrigerant circuit may not include any other components between the bypass control valve and the expansion valve.

The refrigerant circuit may not include any other components between the expansion device and the heat absorbing heat exchanger.

The refrigerant circuit may not include any other components between the heat absorbing heat exchanger and the secondary inlet of the ejector.

According to another aspect, the invention provides a method of controlling a refrigeration system for a carbon dioxide based refrigerant fluid, wherein the refrigeration system comprises: a refrigerant circuit comprising a compression device, a heat rejecting heat exchanger, an ejector, a receiver, an expansion device, and a heat absorbing heat exchanger; wherein the ejector includes a primary inlet, a secondary inlet and an outlet; wherein the receiver includes an inlet, a liquid outlet and a gas outlet; wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet; wherein a suction inlet of the compression device is arranged to receive refrigerant fluid from the gas outlet of the receiver; and wherein the liquid outlet of the receiver is connected via the expansion device to an inlet of the heat absorbing heat exchanger; characterised in that the refrigerant circuit comprises a bypass line and a bypass control valve, with the bypass line providing a fluid connection between the outlet of the heat rejecting heat exchanger and the expansion device; the method comprising: running the refrigeration system in either an ejector mode in which all refrigerant fluid exiting the heat rejecting heat exchanger enters the ejector primary inlet, or a bypass mode of the refrigeration system in which refrigerant fluid exiting the heat rejecting heat exchanger is permitted to flow through the bypass line to the expansion device and then to the heat absorbing heat exchanger without first passing through the ejector; and controlling the bypass control valve to switch to running the refrigeration system in the other of the ejector mode or the bypass mode.

The use of a bypass line to avoid operating the ejector at a low pressure lift has the advantage, in comparison to using an additional refrigerant pump to secure an effective pressure lift over the ejector, reduces the cost and complexity of the refrigeration system. Furthermore, the bypass line consumes no energy, and thus provides a refrigeration system with a lower overall energy consumption.

The bypass control valve may be an on/off valve. The valve may be operated manually (e.g. ball or plug valve), or the refrigeration system may comprise a controller for automatic control of the bypass control valve (e.g. solenoid valve), in order to achieve switching between the bypass mode and the ejector mode.

The bypass line may be arranged to provide a direct connection between the outlet of the heat rejecting heat exchanger and an inlet of the expansion device.

The bypass line may provide a fluid flow path (e.g. a conduit, a pipe) between the outlet of the heat rejecting heat exchanger and an inlet of the expansion device that is only interrupted by the bypass control valve. In other words, the bypass line may comprise no further components.

The bypass line may be arranged such that fluid does not undergo heat exchange with another portion of the refrigeration system i.e. lose and/or gain heat to and/or from another portion of the refrigeration system, when flowing from the outlet of the heat rejecting heat exchanger to the inlet of the expansion device through the bypass line.

By providing a direct connection between the outlet of the heat rejecting heat exchanger and an inlet of the expansion device, the number of components (and complexity) of the refrigeration system is minimised. Thus, when operated in the bypass mode, the refrigeration system provides a simple single-stage vapor-compression refrigeration system. Being able to switch to a simple refrigerant circuit with minimal components provides the option of reliable and robust refrigeration of a temperature controlled environment.

The refrigeration system may include a check valve between the liquid outlet of the receiver and the expansion device.

The bypass control valve may be a three-port valve, wherein a first port of the valve may be connected to the expansion device, a second port of the valve may be connected to the bypass line, and a third port of the valve may be connected to the liquid outlet of the receiver. In the ejector mode of the refrigeration system, the bypass control valve may be controlled to allow fluid communication between the first port and the third port; and in the bypass mode of the refrigeration system, the bypass control valve may be controlled to allow fluid communication between the first port and the second port.

A three-port valve may provide the function of the bypass control valve and the check valve in a single valve, thus reducing the number of components of the refrigeration system and accordingly providing improved reliability and reduced cost.

The method may comprise monitoring an ambient air temperature outside of the refrigeration system; and controlling the bypass control valve to switch to from the ejector mode to the bypass mode in response to determining that the ambient air temperature is below a predetermined threshold.

The method may comprise monitoring an ambient air temperature outside of the refrigeration system; and controlling the bypass control valve to switch from the bypass mode to the ejector mode in response to determining that the ambient air temperature is above a predetermined threshold.

The method may comprise monitoring a refrigerant fluid temperature at an outlet of the heat rejecting heat exchanger; and controlling the bypass control valve to switch from the ejector mode to the bypass mode in response to determining that the refrigerant fluid temperature is below a predetermined threshold.

Thus automatic switching between the ejector mode and the bypass mode in response to external and/or internal conditions is provided.

BRIEF DESCRIPTION OF THE DRAWINGS

Certain preferred embodiments of the present invention will now be described, by way of example only, with reference to the following drawings, in which.

DETAILED DESCRIPTION OF THE INVENTION

Figure 1:
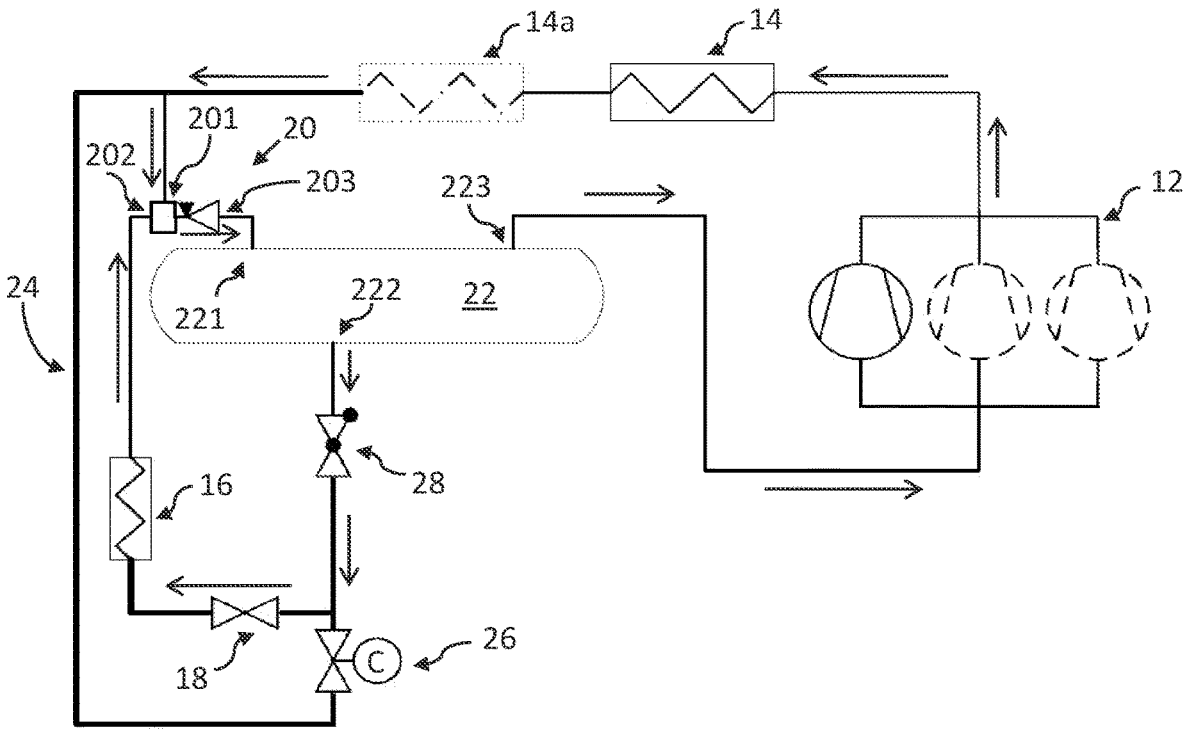
FIG. 1 is a schematic diagram of an ejector refrigeration system including a bypass line, the ejector refrigeration system being run in an ejector mode of operation.

As seen in FIG. 1, a refrigeration system includes a compression device 12, a heat rejecting heat exchanger 14, an ejector 20, a receiver 22, an expansion device 18 and a heat absorbing heat exchanger 16 that together form an ejector refrigerant circuit. The ejector refrigerant circuit contains a carbon dioxide based refrigerant fluid (e.g. R744) and circulation of the refrigerant fluid via the compression device 12 enables the ejector refrigeration system to utilise a refrigeration cycle to satisfy a cooling load. In this example the compression device 12 is at least one compressor 12 for compression of the carbon dioxide based refrigerant fluid, the heat rejecting heat exchanger 14 is a gascooler for at least partially condensing the refrigerant fluid, and the heat absorbing heat exchanger 16 is an evaporator for at least partially evaporating the refrigerant fluid. The refrigeration system may advantageously be arranged so that the fluid is fully condensed at the gascooler 14, and fully evaporated at the evaporator 16.

The refrigeration system is configured to provide control and maintenance of temperature conditions of an environment, such as the inside of a freezer cabinet. The ejector refrigerant circuit may be situated outside of the temperature controlled environment. Air passages may be provided to allow air to circulate between the ejector refrigerant circuit and the temperature controlled environment, and the refrigeration system may include fans (not shown) configured to direct ambient air across the gascooler 14 and air across the evaporator 16 to or from the temperature controlled environment.

The ejector 20 comprises a primary inlet 201 (e.g. a high-pressure motive inlet), a secondary inlet 202 (e.g. a low-pressure suction inlet) and an outlet 203. The ejector 20 includes a high-pressure fluid passage extending from the primary inlet 201 to a high-pressure fluid nozzle; a suction fluid passage extending from the secondary inlet 202 to a suction chamber surrounding the high-pressure fluid nozzle; a mixing chamber 204 in fluid communication with the high-pressure fluid passage and the suction fluid passage respectively; and a diffusion chamber 205 downstream of the mixing chamber 204. The working principle of the ejector 20 is generally described as follows: a high-pressure fluid is converted into a high-momentum fluid when passing through the high-pressure fluid nozzle, the suction fluid is suctioned into the mixing chamber with the high-momentum fluid and mixed with the high-momentum fluid in the mixing chamber, and then diffuses in the diffusion chamber to recover the pressure of the fluid, the fluid then passing through the outlet 203.

The receiver 22 (e.g. an accumulator) comprises an inlet 221, a liquid outlet 222 and a gas outlet 223. Inlet 221 is connected to the outlet 203 of the ejector 20 and receives refrigerant fluid therefrom, the liquid outlet 222 is connected to the inlet of the expansion device 18, and the gas outlet 223 is connected to the inlet of the compressor 12. In many cases it is beneficial to avoid the presence of liquid at the inlet to the compressor 12.

The refrigeration system includes a bypass line 24 for use in a bypass mode of operation. The inlet of the bypass line 24 is attached to the ejector refrigerant circuit via the line between the outlet of the gascooler 14 and the primary inlet 201 of the ejector. The outlet of the bypass line 24 is attached to the ejector refrigerant circuit via the line between the liquid outlet 222 of the receiver 22 and the inlet of the expansion valve 18.

The bypass line 24 includes a bypass control valve 26, which is shown as a solenoid valve with an open state and a closed state. Optionally, the ejector refrigerant circuit may include a check valve 28 on the line between the outlet of the receiver 22 and the inlet of the expansion valve 18. In this embodiment, as shown in FIG. 1, the outlet of the bypass line 24 is attached to the ejector refrigerant circuit via the line between the outlet of the check valve 28 and the inlet of the expansion valve 18.

In an alternative embodiment, the bypass control valve 26 is a three-port valve. The first port of the valve 26 is connected to the inlet of the expansion device 18, a second port of the valve 26 is connected to the outlet of the bypass line 24, and a third port of the valve 26 is connected to the liquid outlet 222 of the receiver 22. The use of a three-port valve prevents fluid communication between the liquid outlet 222 of the receiver 22 and the outlet of the bypass line 24, such that the need for the check valve 28 is eliminated.

Optionally, the ejector refrigerant circuit may comprise a plurality of gascoolers, e.g. first gascooler 14 and second gascooler (heat rejecting heat exchanger) 14*a*. The first gascooler 14 and second gascooler 14*a* may advantageously be arranged so that the fluid is fully condensed at the outlet of the second gas cooler 14*a*.

Optionally, the ejector refrigerant circuit may comprise a plurality of evaporators (not shown).

Optionally, the compression device 12 may comprise a plurality of compressors in parallel.

Optionally, the ejector 20 may comprise a plurality of ejectors in parallel.

The refrigeration system may include a controller (not shown) for automatic control of the bypass control valve 26. The refrigeration system may include various temperature and pressure sensors (not shown) in wired or wireless communication with the controller.

The operation of the refrigeration system is now described with reference to FIGS. 1 and 2.

With reference to FIG. 1, in an ejector mode of operation the carbon dioxide based refrigerant fluid flows through the ejector refrigerant circuit, and does not flow through the bypass line 24.

Figure 2:
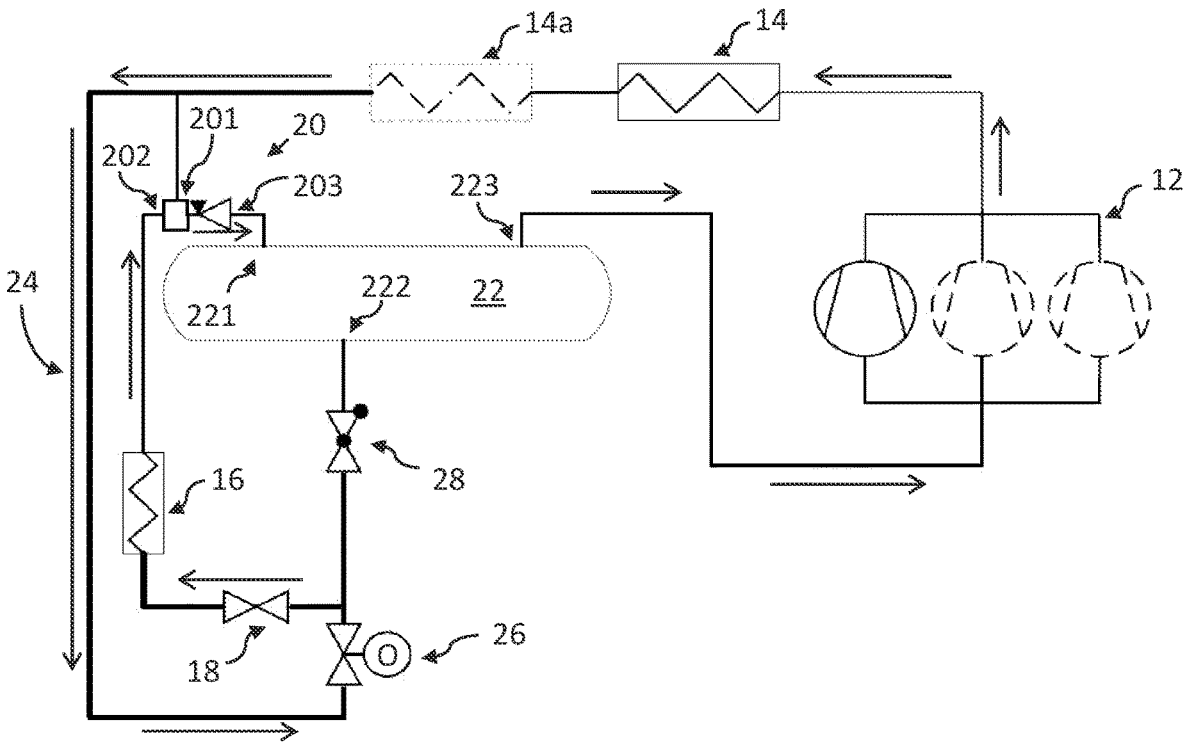
FIG. 2 is a schematic diagram of the ejector refrigeration system of FIG. 1, the ejector refrigeration system being run in a bypass mode of operation.

With reference to FIG. 2, in a bypass mode of operation the carbon dioxide based refrigerant fluid flows through the bypass line 24, and does not flow through the primary inlet 201 of the ejector 20. When running in a bypass mode of operation the carbon dioxide based refrigerant fluid flows through the compressor 12, the gascooler 14, the expansion valve 18 and the evaporator 16 in that order, and accordingly the refrigeration system can be considered to be operating as a typical single-stage vapor-compression refrigeration system. During the bypass mode of operation the ejector 20 acts as conduit between the secondary inlet 202 and the outlet 203 for the refrigerant fluid flow. Similarly, the receiver 22 acts as a conduit for between the inlet 221 and the gas outlet 223.

The ejector mode of operation may be initiated automatically, for example upon start-up. Alternatively, on start-up, the controller may be configured to determine whether the refrigeration system should be initiated in the ejector mode of operation or the bypass mode of operation.

During the operation of the refrigeration system (in either the ejector mode or the bypass mode) the controller may be configured to switch to a different mode of operation in response to received information (e.g. measurements). The controller may receive temperature measurements from sensors, such as a sensor for ambient air temperature (outside air temperature), a sensor for temperature of the temperature controlled environment, and/or sensors within the ejector refrigerant circuit or the bypass line such as for measuring temperatures and/or pressures. The sensors may be comprised as a part of the refrigeration system.

Alternatively the switching may be performed manually, by a user (e.g. engineer or operator) or performed automatically, for example at certain times of the day.

Advantageously, in situations when the ambient air temperature (outside air temperature) is high (e.g. during the day and/or during summer), the refrigeration system can switch to be ran in the ejector mode. When the ambient air temperature is high, the fluid leaving the outlet of the gascooler is correspondingly also at a high temperature (and a high pressure). Accordingly, because the pressure of the motive fluid (i.e. the fluid entering the primary inlet 201 of the ejector 20) is high enough to provide a sufficient pressure lift to the suction fluid (i.e. the fluid entering the secondary inlet 202), the performance advantages of the ejector 20 (such as improved efficiency and/or productivity of the refrigeration system) can be realised.

However, in situations when the ambient air temperature (outside air temperature) is low (e.g. during the night and/or during winter), the fluid leaving the outlet of the gascooler is correspondingly at a low temperature (and a low pressure). As such, because the pressure of the motive fluid is low, the pressure lift provided by the ejector 20 is low. The ejector 20 thus operates poorly and the performance of the refrigeration system suffers.

Advantageously, the refrigeration system can switch to be ran in the bypass mode if it is determined that the ambient air temperature, or the temperature and/or pressure of the motive fluid (i.e. the fluid leaving the outlet of the gascooler 14) is low, e.g. below a predetermined threshold.

As discussed above, when operated in the bypass mode, the bypass valve 26 is opened. Essentially all the fluid flowing from the output of the gascooler 14 thus flows through the bypass line 24, as the high-pressure nozzle of the ejector 20 presents a significantly higher pressure barrier for the refrigerant fluid to overcome (as opposed to the expansion valve 18). Thus the ejector 20 does not act as an ejector but acts instead as a fluid conduit (e.g. pipe), providing fluid communication between the outlet of the evaporator 16 and the inlet 221 of the receiver. Thus, in accordance with an embodiment of the invention, the refrigeration system is operated as a typical single-stage vapor-compression refrigeration system in conditions where the operation of the ejector 20 would be detrimental to the performance of the refrigeration system.

The refrigeration system may not include any components or elements other than those shown in FIG. 1 and FIG. 2, i.e. the refrigeration system may consist of a compression device 12, a heat rejecting heat exchanger 14, an ejector 20, a receiver 22, an expansion device 18, a heat absorbing heat exchanger 16, a bypass line 24, a bypass control valve 26 and a check valve 28. Alternatively, the refrigeration system may consist of a compression device 12, a heat rejecting heat exchanger 14, an ejector 20, a receiver 22, an expansion device 18, a heat absorbing heat exchanger 16, a bypass line 24 and a three-port bypass control valve 26.

The refrigeration system may also include other more complex additions to the ejector refrigerant circuit or bypass line 24 such as to adapt the refrigeration system for particular requirements.

What is claimed is:

1. A refrigeration system for a carbon dioxide based refrigerant fluid, wherein the refrigeration system comprises a refrigerant circuit, the refrigerant circuit comprising one or more compressors, a heat rejecting heat exchanger, an ejector, a receiver, an expansion valve and a heat absorbing heat exchanger;

wherein the ejector includes a primary inlet, a secondary inlet and an outlet;

wherein the receiver includes an inlet, a liquid outlet and a gas outlet;

wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet;

wherein a suction inlet of the one or more compressors is arranged to receive refrigerant fluid from the gas outlet of the receiver; and wherein the liquid outlet of the receiver is connected via the expansion valve to an inlet of the heat absorbing heat exchanger;

wherein the refrigeration system comprises a bypass line and a bypass control valve, with the bypass line providing a fluid connection between the outlet of the heat rejecting heat exchanger and the expansion valve, wherein, in an ejector mode of the refrigeration system, the bypass control valve prevents fluid flow through the bypass line such that all fluid exiting the heat rejecting heat exchanger enters the ejector primary inlet;

wherein, in a bypass mode of the refrigeration system, the bypass control valve permits fluid exiting the heat rejecting heat exchanger to flow through the bypass line to the expansion valve and then to the heat absorbing heat exchanger without first passing through the ejector;

wherein the refrigeration system comprises a controller, the controller being configured to control the bypass control valve;

wherein the refrigeration system comprises a sensor for monitoring an ambient air temperature, and wherein either: (i) the controller is configured to control the bypass control valve to switch to the bypass mode of the refrigeration system in response to determining that the ambient air temperature is below a predetermined threshold; or (ii) the controller is configured to control the bypass control valve to switch to the ejector mode of the refrigeration system in response to determining that the ambient air temperature is above a predetermined threshold.

2. The refrigeration system as claimed in claim 1, wherein the bypass line is arranged to provide a direct connection between the outlet of the heat rejecting heat exchanger and an inlet of the expansion valve.

3. The refrigeration system as claimed in claim 1, wherein the bypass line provides a direct fluid flow path that is only interrupted by the bypass control valve.

4. The refrigeration system as claimed in claim 2, wherein the bypass line is arranged such that fluid does not undergo heat exchange with another portion of the refrigeration system when flowing from the outlet of the heat rejecting heat exchanger to the inlet of the expansion valve through the bypass line.

5. The refrigeration system as claimed in claim 1, wherein the refrigeration system includes a check valve between the liquid outlet of the receiver and the expansion valve.

6. The refrigeration system as claimed in claim 1, wherein the bypass control valve is a three-port valve, a first port of the valve being connected to the expansion valve a second port of the valve being connected to the bypass line, and a third port of the valve being connected to the liquid outlet of the receiver;

wherein, in the ejector mode of the refrigeration system, the bypass control valve allows fluid communication between the first port and the third port; and wherein, in the bypass mode of the refrigeration system, the bypass control valve allows fluid communication between the first port and the second port.

7. The refrigeration system as claimed in claim 1, wherein the refrigeration system comprises a refrigerant fluid temperature sensor or refrigerant fluid pressure sensor located between the outlet of the heat rejecting heat exchanger and the ejector primary inlet, and wherein the controller is configured to control the bypass control valve to initiate the bypass mode based on a sensed temperature or a sensed pressure of the refrigerant at the outlet of the heat rejecting heat exchanger.

8. A method of controlling a refrigeration system for a carbon dioxide based refrigerant fluid, wherein the refrigeration system comprises:

a refrigerant circuit comprising one or more compressors a heat rejecting heat exchanger, an ejector, a receiver, an expansion valve and a heat absorbing heat exchanger;

wherein the ejector includes a primary inlet, a secondary inlet and an outlet;

wherein the receiver includes an inlet, a liquid outlet and a gas outlet;

wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet;

wherein a suction inlet of the one or more compressors is arranged to receive refrigerant fluid from the gas outlet of the receiver; and wherein the liquid outlet of the receiver is connected via the expansion valve to an inlet of the heat absorbing heat exchanger;

wherein the refrigerant system comprises a bypass line and a bypass control valve, with the bypass line providing a fluid connection between the outlet of the heat rejecting heat exchanger and the expansion valve the method comprising:

running the refrigeration system in either an ejector mode in which all refrigerant fluid exiting the heat rejecting heat exchanger enters the ejector primary inlet, or a bypass mode of the refrigeration system in which refrigerant fluid exiting the heat rejecting heat exchanger is permitted to flow through the bypass line to the expansion valve and then to the heat absorbing heat exchanger without first passing through the ejector; and controlling the bypass control valve to switch to running the refrigeration system in the other of the ejector mode or the bypass mode;

wherein the bypass control valve is controlled by a controller and the method comprises either:

(i) monitoring an ambient air temperature outside of the refrigeration system; and controlling the bypass control valve to switch from the ejector mode to the bypass mode in response to determining that the ambient air temperature is below a predetermined threshold; or (ii) monitoring a refrigerant fluid temperature or pressure at an outlet of the heat rejecting heat exchanger; and controlling the bypass control valve to switch from the ejector mode to the bypass mode in response to determining that the refrigerant fluid temperature or pressure is below a predetermined threshold.

9. The method of controlling a refrigeration system for a carbon dioxide based refrigerant fluid as claimed in claim 8, wherein the method comprises:

monitoring an ambient air temperature outside of the refrigeration system; and controlling the bypass control valve to switch from the bypass mode to the ejector mode in response to determining that the ambient air temperature is above a predetermined threshold.

10. A refrigeration system for a carbon dioxide based refrigerant fluid, wherein the refrigeration system comprises a refrigerant circuit, the refrigerant circuit comprising one or more compressors a heat rejecting heat exchanger, an ejector, a receiver, an expansion valve and a heat absorbing heat exchanger;

wherein the ejector includes a primary inlet, a secondary inlet and an outlet;

wherein the receiver includes an inlet, a liquid outlet and a gas outlet;

wherein the ejector primary inlet is arranged to receive fluid from an outlet of the heat rejecting heat exchanger, the ejector secondary inlet is arranged to receive fluid from an outlet of the heat absorbing heat exchanger, and the ejector outlet is arranged to direct flow to the receiver inlet;

wherein a suction inlet of the one or more compressors s arranged to receive refrigerant fluid from the gas outlet of the receiver; and wherein the liquid outlet of the receiver is connected via the expansion valve to an inlet of the heat absorbing heat exchanger;

wherein the refrigeration system comprises a bypass line and a bypass control valve, with the bypass line providing a fluid connection between the outlet of the heat rejecting heat exchanger and the expansion valve;

wherein, in an ejector mode of the refrigeration system, the bypass control valve prevents fluid flow through the bypass line such that all fluid exiting the heat rejecting heat exchanger enters the ejector primary inlet;

wherein, in a bypass mode of the refrigeration system, the bypass control valve permits fluid exiting the heat rejecting heat exchanger to flow through the bypass line to the expansion valve and then to the heat absorbing heat exchanger without first passing through the ejector;

wherein the refrigeration system comprises a controller, the controller being configured to control the bypass control valve;

wherein the refrigeration system comprises a refrigerant fluid temperature sensor or refrigerant fluid pressure sensor located between the outlet of the heat rejecting heat exchanger and the ejector primary inlet, and wherein the controller is configured to control the bypass control valve to initiate the bypass mode based on a sensed temperature or a sensed pressure of the refrigerant at the outlet of the heat rejecting heat exchanger.

11. The refrigeration system as claimed in claim 10, wherein the bypass line is arranged to provide a direct connection between the outlet of the heat rejecting heat exchanger and an inlet of the expansion valve.

12. The refrigeration system as claimed in claim 10, wherein the bypass line provides a direct fluid flow path that is only interrupted by the bypass control valve.

13. The refrigeration system as claimed in claim 11, wherein the bypass line is arranged such that fluid does not undergo heat exchange with another portion of the refrigeration system when flowing from the outlet of the heat rejecting heat exchanger to the inlet of the expansion valve through the bypass line.

14. The refrigeration system as claimed in claim 10, wherein the refrigeration system includes a check valve between the liquid outlet of the receiver and the expansion valve.

15. The refrigeration system as claimed in claim 10, wherein the bypass control valve is a three-port valve, a first port of the valve being connected to the expansion valve a second port of the valve being connected to the bypass line, and a third port of the valve being connected to the liquid outlet of the receiver;

wherein, in the ejector mode of the refrigeration system, the bypass control valve allows fluid communication between the first port and the third port; and wherein, in the bypass mode of the refrigeration system, the bypass control valve allows fluid communication between the first port and the second port.

16. The refrigeration system as claimed in claim 10, wherein the refrigeration system comprises a sensor for monitoring an ambient air temperature, and wherein the controller is configured to control the bypass control valve to switch to the bypass mode of the refrigeration system in response to determining that the ambient air temperature is below a predetermined threshold.

17. The refrigeration system as claimed in claim 10, wherein the refrigeration system comprises a sensor for monitoring an ambient air temperature, and wherein the controller is configured to control the bypass control valve to switch to the ejector mode of the refrigeration system in response to determining that the ambient air temperature is above a predetermined threshold.

* * * * *